US006318420B1

(12) United States Patent
Rodriguez

(10) Patent No.: US 6,318,420 B1
(45) Date of Patent: Nov. 20, 2001

(54) CONSTANT FLOW DISTRIBUTION VALVE

(76) Inventor: Dean K. Rodriguez, HC65, P.O. Box 190, Animas, NM (US) 88020

( * ) Notice: Subject to any disclaimer, the term of this patent is extended or adjusted under 35 U.S.C. 154(b) by 0 days.

(21) Appl. No.: 09/594,140

(22) Filed: Jun. 14, 2000

(51) Int. Cl.[7] ..... B67C 3/02
(52) U.S. Cl. ..... 141/145; 137/625.15
(58) Field of Search ..... 137/625.13, 625.15; 141/145–152

(56) References Cited

U.S. PATENT DOCUMENTS 2,797,707 * 7/1957 Hursh ..... 137/625.15

* cited by examiner

*Primary Examiner*—David J. Walczak
*Assistant Examiner*—Peter DeVore
(74) *Attorney, Agent, or Firm*—LaValle D. Ptak

(57) ABSTRACT

A constant flow distribution valve, particularly suited as the filler valve for a canning system, is constructed in the form of at least three stacked circular plates. The top or uppermost one of these plates has an elongated slot formed in it near the circumference, and oriented perpendicular to a radius of the top plate or concentrically with the circumference of the plate. This plate is mounted in a non-rotational position in the canning apparatus. A second plate and an indexing member are mounted together for rotation beneath the first plate. The second plate has its center line aligned with the center of the top plate, and includes a series of equally spaced distribution openings through it, with the openings aligned with the slot in the first plate as the second plate is rotated. Beneath the second plate is an indexing member for locating containers to be filled beneath each of the distribution openings in the second plate. The indexing member is continuouly rotated with the second plate at a rate synchronized with the rate of the supply of material to be canned through the slot. This causes a measured amount of product to be placed in each container carried by the indexing plate beneath the second plate.

17 Claims, 3 Drawing Sheets

CONSTANT FLOW DISTRIBUTION VALVE

BACKGROUND

In the canning industry, automated and semi-automated systems are employed for rapidly filling a large number of cans or other containers with food product. Because of the nature of most crops, the canning season itself is quite short, dependent upon the peak harvest time of the crops being canned. As a consequence, large volumes of foodstuffs must be processed and canned (or bottled) in a relatively short period of time. Thus, the speed and efficiency at which automated canning systems are operated is crucial to the cost effective production of the finished product.

Liquid products, such as juices are relatively simple to process; and a variety of efficient automated systems exist for transferring such products from large reservoirs or vessels into individual containers, which then are sealed and processed for ultimate delivery to a consumer. With respect to semi-solid products such as chiles, tomatoes, salsa and other products of similar consistency, efficient canning systems generally have not been available.

For canning semi-solid products such as diced chiles, salsa or the like, it has been the practice in the past to move the cans or containers to be filled by means of a conveyor past a fill position. At the fill position, it generally has been the practice to utilize a piston filler employing vacuum and cam devices to control the fill for each can located at the fill position. Such piston filler systems may have as many as fifty or more valves on one machine. All of these valves have gaskets and cams and many moving parts. As a consequence, mechanical failures can and do occur. When such failures occur, the filling machine must be shut down while repairs are made. Such down times are critical in view of the necessity of rapidly processing the foodstuffs which are to be canned.

The accuracy of the fill in piston type fillers also depends on the condition of the wear of the machine parts and the viscosity of the product itself. Because the viscosity can change with every batch of product, the fill varies substantially in weight from batch to batch, and even from one time period to the next, because of the variables which exist. Adjustment of piston type filler machines to fine tune the product fill is difficult, since in most such machines adjustment of one valve to fill more or less causes all of the other valves on the same machine also to fill more or less. Using of piston fill machines requires vigilant quality control to remove underweight or significantly overweight containers from the production line.

Another disadvantage which exists with respect to piston type filler machines used in canneries is that a large amount of spillage or dropped product occurs on these lines. As the fillers become worn and the tolerances of the various parts lose precision, significant amount of product can be lost. This product loss can be as much as 1,000 pounds per hour on each filler line. Since the product which is supplied to the cans has already undergone substantial processing (it is not raw product from the field), the cost of this wasted product is significant. Even if the piston type fillers at a plant are updated and are operating at peak efficiency, the inherent construction of these fillers is that there will be and is product loss. Even if only one ounce of product is lost per container, the total amount of product loss can be significant. For example, on a typical run it is possible to fill 250 cans per minute. At one ounce loss per can (with product value of 25 cents per ounce), on a line running for twenty hours a day, this amounts to a loss of $75,000 per day for such a line.

This is the loss for a relatively efficient line. It has been discovered that less efficient lines may lose over 1,000 pounds of product per hour, on each canning line.

It is desirable to provide an efficient distribution valve which is particularly suitable for food canning lines, which accurately fills the containers, which reduces spillage of product to a minimum, and which is mechanically simple to construct and operate.

SUMMARY OF THE INVENTION

It is an object of this invention to provide an improved distribution valve.

It is another object of this invention to provide an improved constant flow distribution valve.

It is an additional object of this invention to provide an improved constant flow distribution valve for use as a filler valve for canning foodstuffs.

It is a further object of this invention to provide an improved constant flow distribution valve employing a significantly reduced number of moving parts for use as a filler valve in a food canning system.

In accordance with a preferred embodiment of the invention, a constant flow distribution valve includes first and second plates mounted for relative rotation with respect to one another. The first plate has an elongated slot in it; and this slot has a pre-established length. The second plate has a plurality of uniformly spaced distribution openings through it for sequential alignment with the slot in the first plate when the two plates are rotated relative to one another. The distance between the adjacent openings in the second plate is selected to be no greater than the length of the slot in the first plate.

DETAILED DESCRIPTION

Reference now should be made to drawings, in which the same reference numbers are used throughout the different FIGS. to designate the same components. Initially, reference should be made to FIG. 1 which illustrates an automated canning system employing a preferred embodiment of the invention.

Figure 1:
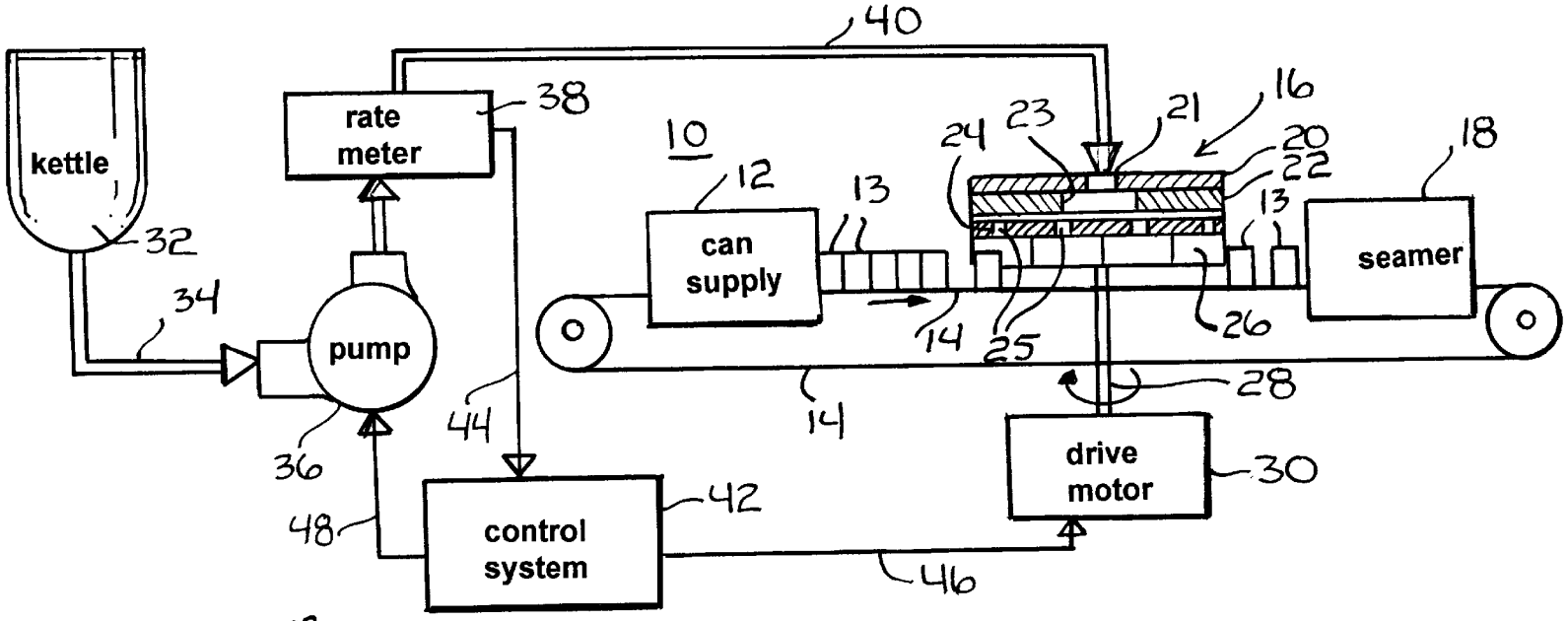
FIG. 1 is a schematic diagram of a canning system in which a preferred embodiment of the invention is used.

The canning system 10 shown in FIG. 1 employs a conventional can supply 12 for supplying properly oriented empty cans 13 on a conveyor 14 to a fill station 16, which is diagrammatically illustrated to incorporate the features of a preferred embodiment of the invention. After the cans 13 have been filled at the fill station 16, they continue to be moved by the conveyor 14 to a seamer 18, which seals the cans 13 for further processing and labeling. With the exception of the unique features of the filler station 16 shown in FIG. 1, the portion of the automated can or container fill system shown in FIG. 1 from the can supply portion 12 to the seamer 18, is in accordance with standard cannery practices and may be implemented in a variety of conventional forms. As a consequence, no explanation of the details of this portion of the system are considered necessary.

Figure 3:
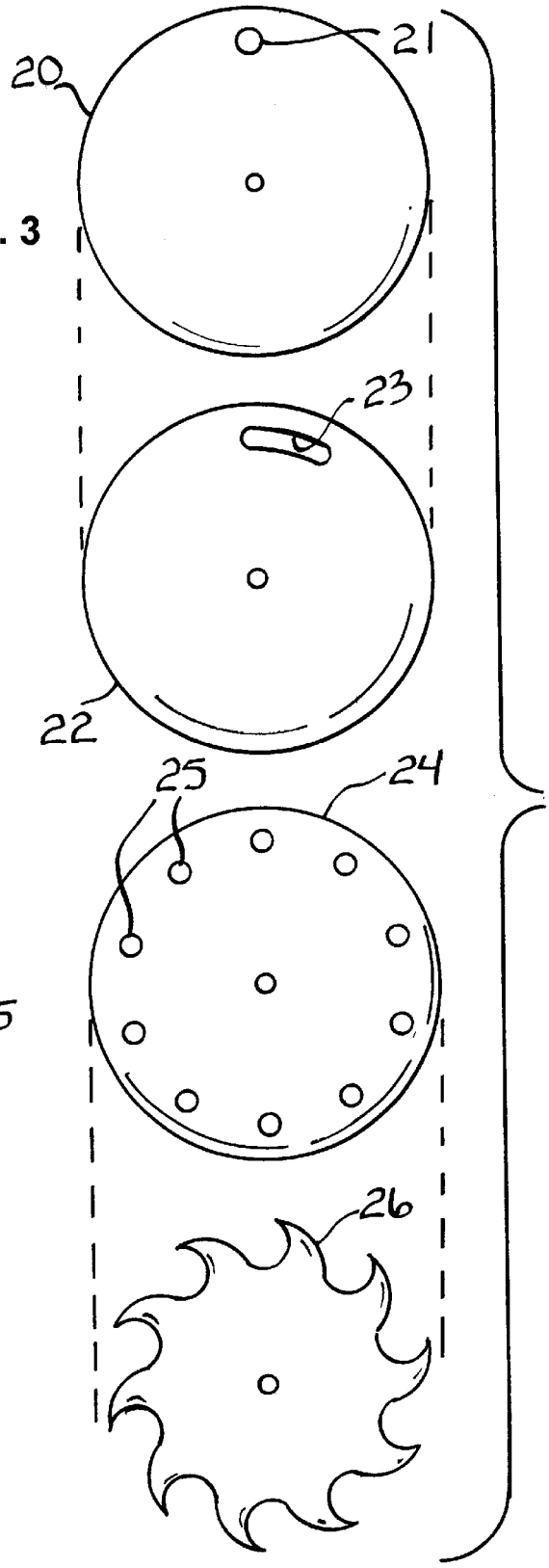
FIG. 3 is a detailed bottom view of the components of a preferred embodiment of the invention.
Figure 2:
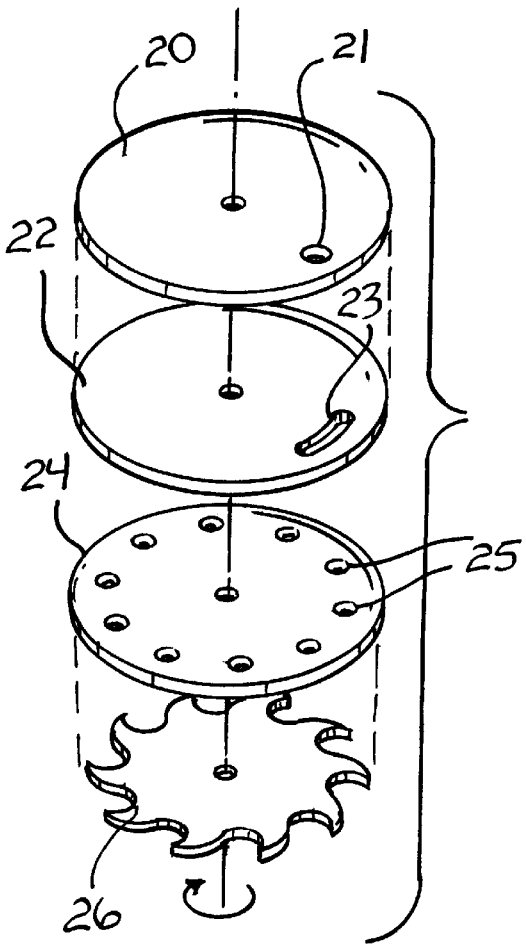
FIG. 2 is a detailed exploded top perspective view of features of the preferred embodiment of the invention.

In accordance with a preferred embodiment of the invention, however, the fill station 16 employs a constant flow distribution valve consisting of four circular plates (see FIGS. 2 and 3 for details). These plates include a top plate 20 having a circular aperture 21 in it. Attached to, and located immediately beneath the top plate 20, is another circular plate 22 with an elongated slot 23 located near its outer circumference. As shown in the embodiment of FIGS. 2 and 3, the slot 23 is a curved configuration the center line of which is concentric with the outer circumference of the circular plate 22.

The plates 20 and 22 are mounted in a fixed position on a frame (not shown), which can be any suitable frame for a canning machine. This frame typically includes a portion which holds the conveyor apparatus 14 and the can supply station 12 and seamer 18. What is important to note, however, is that the plates 20 and 22 are mounted in a fixed position as shown in FIG. 1 and in the orientation shown in FIGS. 2 and 3, as part of a constant flow fill valve for filling cans 13 supplied from the can supply 12 and passing through the fill station 16.

Located immediately below the slotted plate 22 is a distribution plate 24, having uniformly, or equi-angularly, spaced circular holes or distribution openings 25 located through it, near the outer circumference of the plate 24. The center lines of the holes 25 are aligned with the center line of the slot 23. The distance between the center lines of the holes 25 also is selected to be no less than the length of the slot 23 for reasons discussed in greater detail subsequently. An indexing wheel 26 is located beneath the plate 24. The wheel 26 is attached to the distribution plate 24 for rotation with the distribution plate.

Figure 4:
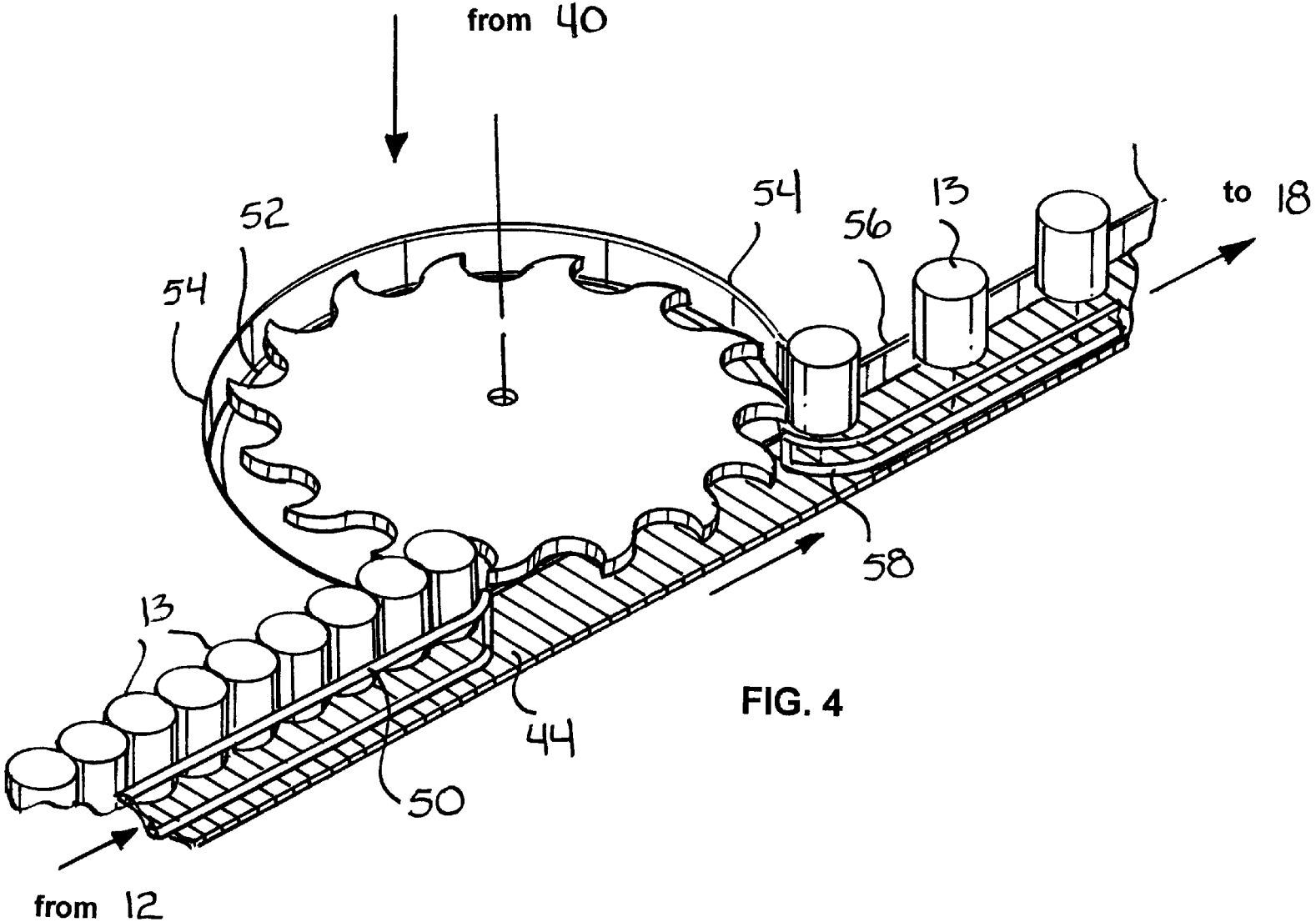
FIG. 4 is a diagrammatic perspective view illustrating a feature of the operation of the preferred embodiment of the invention as used in a system of the type shown in FIG. 1.

As is apparent from an examination of FIGS. 2, 3 and 4, the indexing wheel 26 has a general appearance of a saw blade for a rotary saw, with a circular pocket located behind each of the outer "teeth" of the indexing wheel 26. The pockets are selected to conform with the outer diameter of cans 13 or other containers which are to be filled by the system. As indicated in FIGS. 1, 2 and 4, the indexing wheel is designed to rotate in a clockwise direction in the embodiment of the system which is illustrated in the various drawings. In the bottom view of FIG. 3, rotation is counterclockwise. Although the indexing wheel 26 is connected to the distribution plate 24 for rotation with the plate, there can be, and usually is, a space between the bottom of the plate 24 and the top surface of the indexing wheel 26 to allow the teeth of the indexing wheel 26 to engage individual cans 13, as they are fed by the conveyor 14 to the filler station 16.

The holes 25 through the distribution plate 24 are each located directly.over the center of the location for each of the cans 13, which are carried by the indexing wheel 26 in the operation of the system. Consequently, product which is supplied through the distribution valve 16, shown in detail in FIGS. 2 and 3, flows through the inlet hole 21 into the slot 23, and then, in the manner described subsequently, through the filler holes 25 in the distribution plate 24 to enter cans 13 carried by the index wheel 26 beneath each of the filler holes 25.

Reference again should be made primarily to FIG. 1 for the overall operation of the system of the preferred embodiment. In addition to the components which have been described above, the system employs a kettle 32, into which the product to be canned is placed. This product is fed, typically by gravity, through an inlet line 34 to the input of a positive displacement pump 36. The pump supplies the product at a constant flow rate through a line 40, which is monitored by a product rate meter 38. The end of the line 40 is securely attached to the hole 21 in the top plate 20 of the constant flow distribution valve 16. This is the product input point for the system, and is diagrammatically illustrated in FIG. 1. The hole 21 may be located at any point along the length of the slot 23. As generally illustrated in the cross-sectional view of the valve 16 shown in FIG. 1, the hole 21 is shown as centered in the slot 23. It could be located, however, at any point along the slot 23. As a consequence, product flowing from the positive displacement pump 36 and supplied through the line 40 is pumped at a constant rate, to continuously keep the product flow in the slot 23.

Typically, the plates 20 and 22 are made of stainless steel; and the product distribution plate 24 is made of ultra-high molecular weight (UHMW) plastic. This type of plastic is self-lubricating; so that the plate 24 is placed in frictional contact with the lower surface of the slotted plate 22. By doing this, essentially no space is provided between the bottom of the plate 22 and the top of the plate 24. Thus, all product flowing into the slot 23 must flow out of the slot 23 into the equal diameter distribution holes 25 in the plate 24, as the plate 24 rotates. As noted previously, the distance between the centers of the holes 25 in the plate 24 is selected to be no greater than the length of the slot 23. This means that as the relative rotation between the plate 24 and the slotted plate 22 takes place, there is always a uniform area total opening, equal to the area of one of the holes 25 located beneath the slot 23.

As the relative rotation of the plates 22 and 24 takes place, the next hole 25 (for example, moving from 12:00 to 1:00 in the clockwise direction) begins to be filled by the leading edge of the slot 23, while the previous hole 25, which has passed through the entire length of the slot 23, begins to be closed off. The point is reached when 50% of the product in the slot 23 flows into each of two adjacent holes 25. As the plate 24 continues to rotate, the area of the previous hole 25 is closed off by the same percentage that the area of the next hole 25 is increasing , until a single hole 25 is located under the slot 23. Thus, all of the product flow then goes into that single hole (and therefore the can 13 located beneath that hole) in the indexing wheel 26. The total area of hole(s) 25 to which product is supplied, however, never changes.

It is readily apparent that the flow rate never changes under this construction. It is constant. There is no spillage, the flow rate is controlled by a drive motor 30 which rotates a shaft 28 connected to the indexing wheel 26 and the distribution plate 24. The drive motor 30, in turn, has its speed controlled by a control system 42, which also controls the rate of operation of the pump 36. These controls are effected over control lines 46 and 48, respectively, as determined by the output of the rate meter 38 over the line 44 applied to the input of the control system 42. Thus, synchronized operation between the drive motor 30, which rotates the distribution plate 24, and the operation of the positive displacement pump 36 is effected to accurately fill, without spillage, each of the cans 13 which are passed through the system.

FIG. 4 illustrates some of the details of the modifications to a standard system which are employed to utilize the system described above in conjunction with FIGS. 1, 2 and 3. In FIG. 4, a top perspective diagrammatic representation of the conveyor 44 on which the cans 13 travel from the can supply 12 to the fill station 16 is shown. The conveyor 44 is a straight-line conveyor, which also is used to remove the filled cans 13 (shown on the right-hand side of FIG. 4) from the indexing wheel 26 after they have been filled. The filled cans then are moved by the conveyor 44 to the seamer station 18, as described above.

It should be noted in FIG. 4 that the cans 13 which are supplied from the can supply 12 are moved by the conveyor at a sufficiently rapid rate that they back up prior to entering the feed system indexing wheel 26. When they are removed from the indexing wheel 26, the filled cans 13 tend to be spaced apart, as illustrated in FIG. 4. Once again, this is standard for many canning systems. Because the different rates occur, the top surface of the conveyor 44 is made of low friction material to allow the conveyor 44 to slide under the bottoms of the empty cans 13, as the system is operated.

In the operation of the system, the constantly rotating indexing wheel 26 picks off the cans 13, one at a time. Each tooth of the indexing wheel secures a single can 13 and nests it in the circular indentation behind the tooth, as the indexing wheel 26 is rotated clockwise as viewed in FIG. 4. To position the empty cans 13 for engagement by the end of the teeth of the indexing wheel 26, a guide rail 50, which curves toward the teeth and extends above the conveyor surface 44, is provided. Thus, each of the cans 13 is picked off in turn by an individual tooth of the wheel 26; and then the cans are rotated by the indexing wheel 26 on a circular stainless steel rod 52, which is located beneath the bottoms of the cans 23 carried by the indexing wheel 26. An upper or raised circular guide rail 54 keeps the cans 13 from falling outwardly out of the filling station 16.

In order to avoid confusion in the depiction of the details of the system in FIG. 4, the cans which are carried by each of the indexing teeth of the indexing wheel 26 have not been shown, as they are moved around the periphery of the indexing wheel prior to being deposited back on the conveyor 44 at the pick-off rail 58 and guide rail 56. It should be noted, however, that there is a can 13 in every one of the indexing wheel positions, which do not lie over the top of the conveyor 44 between the rail 50 and the rail 58. As the cans are carried by the indexing wheel 26, their open tops also are located directly beneath a different one of the fill holes 25 in the distribution plate 24, as described previously, since the indexing wheel 26 and distribution plate 24 rotate together. The filling then takes place in the manner described above; and full cans 13 are moved from the indexing wheel 26 by the conveyor 44 to the seamer station 18.

An important feature to note with the structure of the invention described above is that conventional canning fill stations employ a linear conveyor 44, of the type shown in FIG. 4, and also use a can supply and a seamer of the general type described previously. There is no modification to this part of the machine. What is accomplished is the replacement of the cumbersome piston pump fill mechanisms, which were employed with the linear conveyor 44, by the simple four-piece structure described above and the portions of which are shown in detail in FIGS. 2 and 3.

It also is readily apparent that there are very few moving parts in this system. There are no cams, valves and levers to adust and to wear out and get out of place. Only two surfaces rotate relative to one another; and these are the lower surface of the slotted plate 22 and the upper surface of the distribution plate 24. By selecting the material of the plate 24 to be UHMW plastic, a very low friction engagement of the surface of the plate 24 with the bottom of the stainless steel plate 22 is provided. Wear in the system thus is kept to a minimum.

Figure 5:
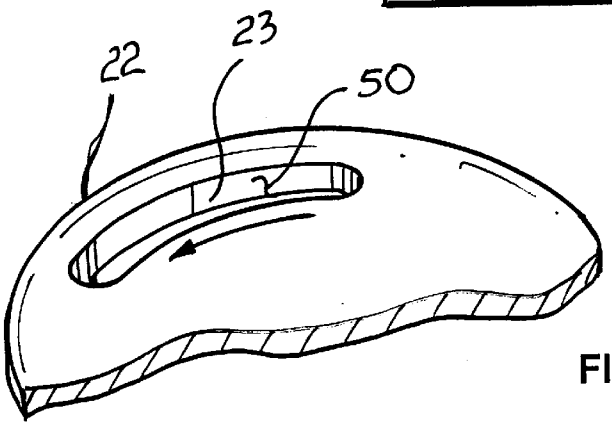
FIG. 5 is a detail of a variation of the preferred embodiment of the invention.

FIG. 5 illustrates a variation of the embodiment which has been described previously. It is possible to design a variable length slot 50 from the minimum length described above in conjunction with FIGS. 1, 2, 3 and 4, to one which is longer (thereby increasing the length of time each can 13 is being filled) as one way of varying the fill operation. So long as the slot 23 has a length equal to or greater than the center-to-center spacing of the fill holes 25, it may be employed. FIG. 5 shows a curved line 50 approximately at the midpoint of the slot 23, to illustrate a variation between a minimum length of the slot and some other greater length which may be employed, if desired. A variable length slot 23 may be designed; or a different plate 22, having a longer slot 23 in it than the basic slot length, may be substituted for the plate 22 described above.

Figure 6:
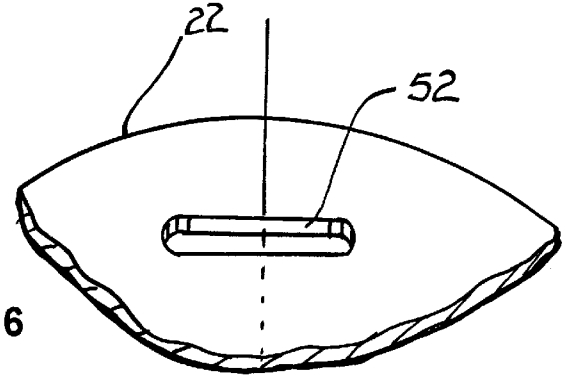
FIG. 6 is a detail of another variation of a preferred embodiment of the invention.

Although the foregoing description also has been made in conjunction with a curved slot, which is generally concentric with the outer circumference of the plate 22, a straight slot 52, as shown in FIG. 6, also may be employed. So long as the parameters described above in conjunction with the relative dimensions of the slot 52 and the holes or openings 25 in the distribution plate 24 are followed, such a straight slot also may be employed.

The foregoing description of the preferred embodiment of the invention is to be considered as illustrative and not as limiting. The relative number of fill openings and the particular position of the hole 21 and slot 23 may be varied without departing from the true scope of the invention. Various changes and modifications will occur to those skilled in the art for performing substantially the same function, in substantially the same way, to achieve substantially the same result without departing from the true scope of the invention as defined in the appended claims.

What is claimed is:

1. A constant flow distribution valve including in combination:

a first plate mounted in a fixed non-rotational position and having an elongated slot therethrough, the slot having a first predetermined length;

a second plate mounted for rotation below the first plate and having a plurality of uniformly spaced distribution openings therethrough for sequential alignment with the slot in the first plate when the first and second plates rotate relative to one another, wherein the distance between corresponding points of adjacent distribution openings in the second plate is no greater than the first predetermined length of the slot in the first plate; and a member coupled for rotation with the second plate for placing containers to be filled in alignment with each of the distribution openings in the second plate as the second plate is rotated beneath the slot in the first plate.

2. The distribution valve according to claim 1 wherein at least the second plate is a flat circular plate.

3. The distribution valve according to claim 1 wherein the second plate comprises a flat circular plate and the first plate has a flat portion in contact with the surface of the second plate, whereupon rotation of said first and second plates relative to one another causes the slot always to open into one or more of the distribution openings in the second plate.

4. The distribution valve according to claim 1 further including a drive mechanism for rotating the second plate.

5. The distribution valve according to claim 4 further including apparatus for delivering product to the slot in the first plate at a predetermined rate; and apparatus for removing product from each of the distribution openings in the second plate sequentially as the first and second plates rotate relative to one another.

6. The distribution valve according to claim 5 further including a positive displacement pump and a source of semi-liquid product coupled to the pump, with the pump supplying semi-liquid product at a constant rate to the slot in the first plate.

7. The distribution valve according to claim 6 further including a system for synchronizing the operation of the positive displacement pump and the drive mechanism for the second plate.

8. The distribution valve according to claim 7 further including a member coupled for rotation with the second plate for placing containers to be filled in alignment with each of the distribution openings in the second plate as the second plate is rotated beneath the slot in the first plate.

9. The distribution valve according to claim 1 further including a drive mechanism for rotating the second plate.

10. The distribution valve according to claim 1 further including a positive displacement pump and a source of semi-liquid product coupled to the pump, with the pump supplying semi-liquid product at a constant rate to the slot in the first plate.

11. A constant flow distribution valve including in combination:

a first plate having an elongated slot therethrough, the slot having a first predetermined length;

a second plate mounted for relative rotation with respect to the first plate and having a plurality of uniformly spaced distribution openings therethrough for sequential alignment with the slot in the first plate when the first and second plates rotate relative to one another, wherein the distance between corresponding points of adjacent distribution openings in the second plate is no greater than the first predetermined length of the slot in the first plate; and a positive displacement pump and a source of semi-liquid product coupled to the pump, with the pump supplying semi-liquid product at a constant rate to the slot in the first plate.

12. The distribution valve according to claim 11 wherein the first plate is mounted in a fixed, non-rotational position above the second plate, and the second plate is rotated.

13. The distribution valve according to claim 12 further including a drive mechanism for rotating the second plate.

14. The distribution valve according to claim 13 further including a system for synchronizing the operation of the positive displacement pump and the drive mechanism for the second plate.

15. A constant flow filler valve for use in a canning system to fill containers, the valve including in combination;

a first circular plate having a center and having an elongated slot therethrough located a predetermined distance from the center, the slot having a first predetermined length;

a second circular plate concentrically mounted beneath and in contact with the first plate for relative rotation thereof with respect to the first plate, the second plate having a plurality of equi-angularly spaced distribution openings therethrough at the predetermined distance from the center thereof for sequential alignment with the slot in the first plate when the first and second plates rotate relative to one another, wherein the distance between adjacent distribution openings is no greater then the first predetermined length of the slot in the first plate;

a container indexing device concentrically mounted and attached to the second plate for locating containers to be filled beneath each of the distribution openings through the second plate as the second plate is rotated relative to the first plate;

a conveyor member for supplying containers to be filled to the container indexing device and for removing filled containers from the container indexing device; and a source of product for the containers supplied at a constant rate to the slot in the first plate.

16. The constant flow filler valve according to claim 15 wherein the source of product includes a container of product and a positive displacement pump coupled thereto for supplying the product at a constant rate to the slot in the first plate.

17. The constant flow filler valve according to claim 16 wherein the first plate is mounted in a non-rotational position and the second plate and the indexing device rotate together beneath the first plate.

* * * * *